United States Patent [19]

Fuhs

[11] 4,399,827

[45] Aug. 23, 1983

[54] HAIR-TINTING IMPLEMENT

[76] Inventor: Hans L. Fuhs, Konigstrasse 87, D-5303 Bornheim, Fed. Rep. of Germany

[21] Appl. No.: 264,168

[22] Filed: May 15, 1981

[30] Foreign Application Priority Data

May 17, 1980 [DE] Fed. Rep. of Germany ..... 3018984
Apr. 23, 1981 [DE] Fed. Rep. of Germany ... 8112037[U]

[51] Int. Cl.[3] ..... A45D 24/26; A46B 11/00

[52] U.S. Cl. ..... 132/112; 132/85; 401/129; 401/286

[58] Field of Search ..... 132/85, 112, 113, 114, 132/116; 401/129, 138, 276, 281, 286

[56] References Cited

U.S. PATENT DOCUMENTS

| | | | |
|---|---|---|---|
| 1,191,604 | 7/1916 | McCurdy | 401/276 |
| 1,659,622 | 2/1928 | Atamian | 401/286 X |
| 2,617,431 | 11/1952 | Gaspari | 132/112 X |
| 2,819,723 | 1/1958 | Meyer | 132/116 |
| 3,101,086 | 8/1963 | DiVito | 132/114 |

*Primary Examiner*—Robert P. Swiatek
*Attorney, Agent, or Firm*—Sughrue, Mion, Zinn, Macpeak and Seas

[57] ABSTRACT

A hair-tinting implement comprises a container containing a tinting medium, and a workhead provided with two tinting-medium outlets. The container is generally cylindrical, and is made of resiliently-deformable plastics material. The workhead is attached to one end of the container, and is provided with a pair of internal ducts which connect the interior of the container to the outlets. The other end of the container is closed off by a screw cap. An air-intake valve is provided in the screw cap, the air-intake valve being such as to open when the pressure in the container is less than that outside the container. The air-intake valve is constituted by a plurality of valve openings passing through the screw cap, a valve seat formed on the interior surface of the screw cap, and a resiliently-deformable valve closure member which overlies the valve seat and the valve openings.

19 Claims, 7 Drawing Figures

HAIR-TINTING IMPLEMENT

BACKGROUND OF THE INVENTION

This invention relates to a hair-tinting implement.

A known hair-tinting implement has a resiliently-deformable plastics tinting-medium container, which acts as a grip, and a workhead. The workhead is connected to the container, and has a spike-like hair spreader, a flat brush, and a comb. The workhead also has at least one internal duct, which leads from the interior of the container to a tinting medium outlet in the workhead. The container is provided, at that of its ends remote from the workhead, with an air-intake valve which opens when the pressure in the container is less than that outside. The devices used for tinting the hair, namely the spike-like hair spreader, the comb, and the flat brush, are arranged on the workhead in such a manner as to suit their functions. The container is compressible, so that the tinting medium can be forced out, onto either the hair spreader or the flat brush, by the application of pressure. Upon the container resiliently recovering its shape, air is drawn into the container through the air-intake valve. This ensures that, when the container recovers its shape, the tinting medium in the duct is not sucked back into the container, but keeps the duct full, so that application of tinting medium in metered quantities is promoted. (See DT-GM No. 79 30 382).

The known implement uses a spring-loaded nonreturn valve as the air-intake valve. The incorporation of such a valve involves relatively high manufacturing and costs. Moreover, such a valve does not function reliably, and can be cleaned only with difficulty. Since the components of the hair-tinting medium have to be mixed in the container, it is practically impossible to prevent the tinting medium from dripping out of the valve when the container is shaken, and thus to prevent unpleasant contamination. Furthermore, the tinting medium is deposited on the operative parts of the valve in the course of time, so that the valve begins to leak. The valve spring suffers corrosion and tends to be affected by fatigue.

The aim of the present invention is to provide a hair-tinting implement which does not suffer from these disadvantages. In particular, the aim of the invention is to provide a hair-tinting implement having an air-intake valve which is simple and economical to produce and assemble; which is reliable, particularly as regards the prevention of dripping and the effects of shaking; which is easy to clean and which is easily and rapidly replaceable.

SUMMARY OF THE INVENTION

The present invention provides a hair-tinting implement comprising a tinting-medium container, and a workhead provided with a tinting-medium outlet, the container being generally cylindrical and being made of resiliently-deformable material, the workhead being attached to one end of the container and being provided with an internal duct which connects the interior of the container to the outlet, the other end of the container being closed off by a sealing member, an air-intake valve being provided in the sealing member, the air-intake valve being such as to open when the pressure in the container is less than the outside the container, wherein the air-intake valve is constituted by at least one valve opening passing through the sealing member, a valve seat formed on the interior surface of the sealing member, and a resiliently-deformable valve closure member which overlies the valve seat and the or each valve opening.

Advantageously, the workhead is provided with a comb, a spike-like hair spreader, and a flat brush.

Preferably, the container is made of resiliently-deformable plastics material, and the sealing member is made of plastics material.

Thus, the air-intake valve of this implement is a component of the sealing member. This arrangement is advantageous in that the important parts of the air-intake valve, together with the sealing member, can be economically produced as an injection-moulded plastics part. Moreover, the valve, together with the sealing member, can easily and rapidly be connected to the container (or removed therefrom for the purpose of cleaning the valve, for example in running water). Furthermore, the resilient closure member can be rapidly and easily replaced, even after a fairly lengthy period of use, only a few simple steps being required for doing this. With the sealing member removed, the valve is more or less exposed, and this is advantageous as it enables cleaning to be carried out thoroughly and easily. A further advantage is that the container, which is open at said other end when the sealing member is removed, is easy to clean.

Preferably, a screw cap constitutes the sealing member, the screw cap having a screw-threaded edge portion which surrounds the air-intake valve and engages a complementary screw-threaded portion at said other end of the container. This facilitates the removal of the sealing member.

The air-intake valve may incorporate a simple rubber diaphragm or the like as the valve closure member, and a separate valve-spring is not necessary.

Advantageously, the sealing member is provided with an integral socket projection which extends into the container and defines a recess in the sealing member, the or each valve opening being provided in the socket projection. In this case, the socket projection may be provided with a plurality of valve openings, all of which are overlaid by the valve closure member. Preferably, a flat disc, such as a rubber disc or the like, constitutes the valve closure member.

This air-intake valve is simple as well as functionally reliable, and does not drip even when the container is vigorously shaken. Moreover, the valve exhibits little tendency to become contaminated; can be easily cleaned; and operates without any disturbing noise. Furthermore, it is completely reliable when either highly fluid or cream-like tinting media are used.

Advantageously, a cup-shaped member is formed integrally with the sealing member, the cup-shaped member accommodating the flat disc. Preferably, the valve seat is a knife-edged annular rib formed integrally with the base of the cup-shaped member, the valve seat surrounding the or each valve opening. The flat disc may be held by a releasable plastics clamping member, such as a clamping ring, inserted into the cup-shaped member. When a clamping member (or clamping ring) of this kind is used, assembly of the valve, and replacement of the flat disc, can be carried out in a rapid and simple manner without the use of special tools. The clamping member (or clamping ring) may be provided with groove-like recesses on that surface bearing against the flat disc.

Considerable simplification in the operation of the implement and improved use thereof can be achieved if the implement has a tinting-medium outlet in its hair spreader as well as in its flat brush. In this case, the workhead is provided with a pair of internal ducts which connect the interior of the container to the two tinting-medium outlets. Preferably, the tinting-medium outlets can be closed selectively or simultaneously, this being achieved with the aid of a valve member, which is provided in the workhead, and which is effective to close either or both of the tinting-medium ducts. With this form of workhead, it is possible to force out the tinting medium at the mouth of the hair spreader or at the flat brush, as required.

BRIEF DESCRIPTION OF THE DRAWINGS

A hair-tinting implement constructed in accordance with the invention will now be described, by way of example, with reference to the accompanying drawings, in which.

DESCRIPTION OF THE PREFERRED EMBODIMENTS

Figure 1:
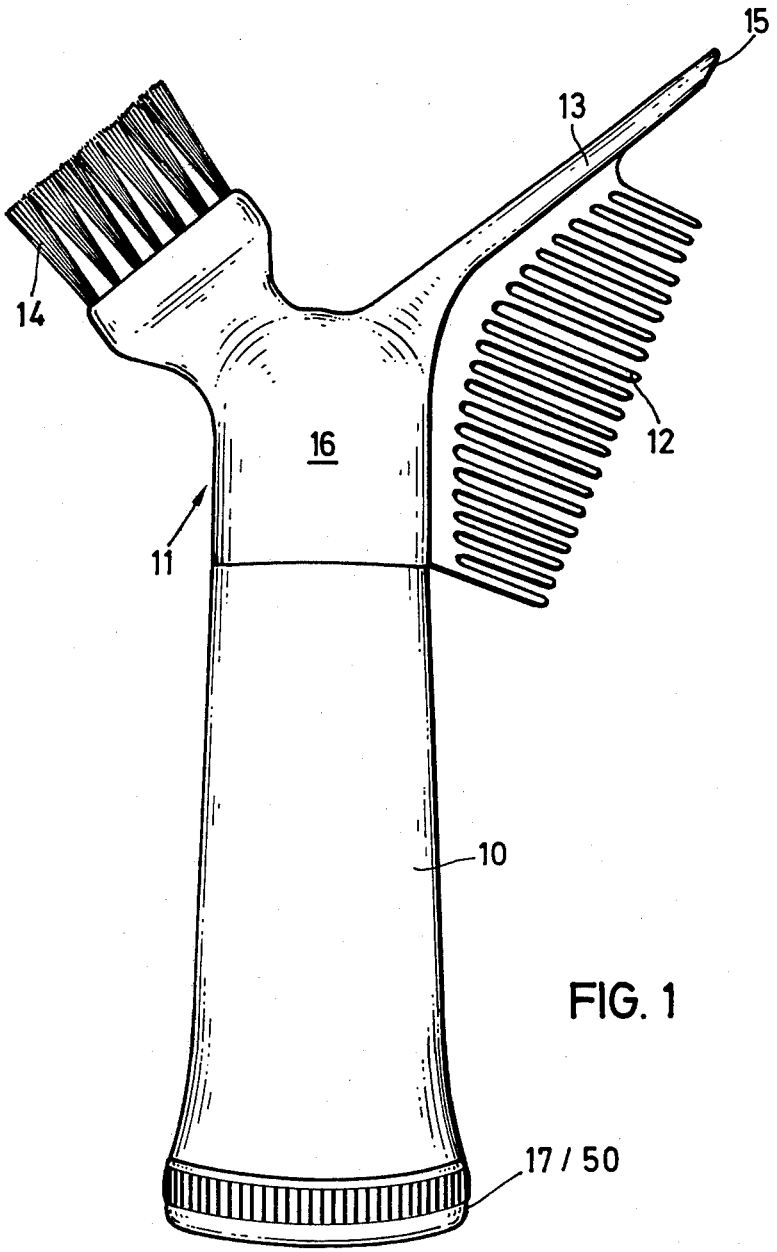
FIG. 1 is a side elevation of the hair-tinting implement.

Referring to the drawings, FIG. 1 shows a hair-tinting implement having a resiliently-deformable container 10 and a workhead 11. The container 10 is made of plastics material, and also forms a grip for the implement. The workhead 11, which is of one-piece construction and is arranged at the upper end of the container 10, is provided with a comb 12, a spike-like spreader 13 and a flat brush 14. The comb 12, the spreader 13, and a support for the brush 14 are integrally formed with a common top piece 16, which is in the form of a screw cap which is screwed on to the upper threaded end (not shown) of the container 10. In use, the container 10 contains tinting medium.

The devices 12, 13 and 14 are arranged on the workhead 11 in a manner suited to their functions; the devices 12 and 13 being disposed at one side of the vertical longitudinal plane of the implement, and the device 14 at the other side of this plane. The container 10 is compressible, so that it can be deformed by hand in order to force the tinting medium through an outlet duct (not shown). The hair spreader 13 has an internal duct (described below with reference to FIG. 2) for the tinting medium. The internal duct terminates at a discharge opening 15 in the tip of the hair spreader 13, the other end of the internal duct communicating with the interior of the container 10 via its outlet duct. By compressing the container 10, the tinting medium can, therefore, be forced through the discharge opening 15 of the hair spreader 13.

The container 10 is of tapered form, its diameter increasing towards its base. In this way, the stability of the entire implement is increased. At its lower end, the container 10 is closed off by a sealing member in the form of a screw cap 17. The screw cap 17 has a sufficiently large base area to enable the implement to stand upright on the screw cap.

Figure 2:
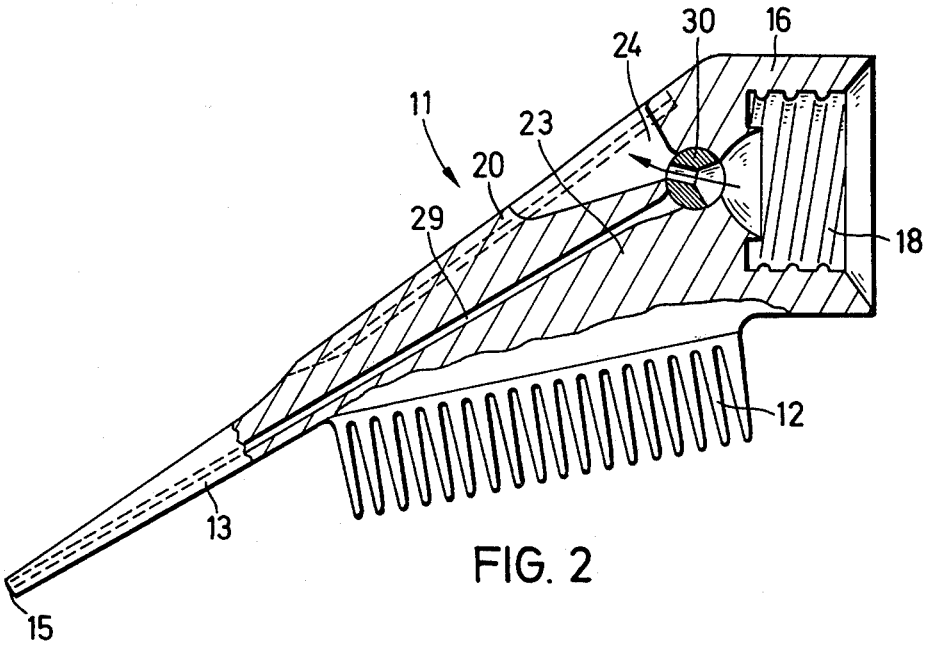
FIG. 2 is a cross-section through part of the workhead of the implement of FIG. 1.
Figure 3:
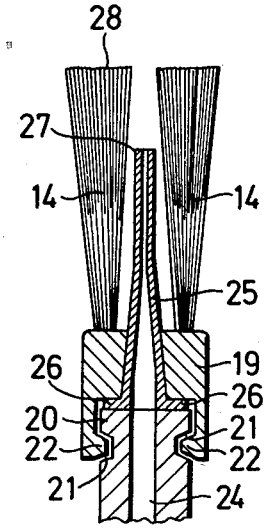
FIG. 3 is a cross-section through part of the workhead and shows a flat brush attached thereto.

FIGS. 2 and 3 show a first form of workhead 11. This workhead 11 is provided with an internal screw thread 18 which enables the workhead to be screwed on to the external thread of the container 10. The flat brush 14 (see FIG. 3) is an attachment which is releasably secured to the workhead 11. The brush 14 has a base 19 which, by means of a groove-and-tongue connection 21, 22 (to be described below), can be slidably fitted on, and secured to, a rear surface 20 of the workhead 11. The rear surface 20 forms a rearward extension of the hair spreader 13. Grooves 21 are formed in the workhead 11 at each side of the rear surface 20, projections 22 on the base 19 of the flat brush 14 engaging in these grooves. The groove-and-tongue connection 21, 22 is formed as a dovetail guide, so that the flat brush 14 is clamped by its base 19 to the workhead 11.

The flat middle portion 23 of the workhead 11 is provided with a slot-like internal duct 24 for the tinting medium; the duct extending from the screw cap 16 to the rear surface 20, and widening as it approaches this rear surface. The width of the duct 24, at the zone where it communicates with the rear surface 20, is only slightly smaller than the width of the flat brush 14. A nozzle 25 is positioned between the sets of bristles of the flat brush 14; the nozzle being formed as a flat funnel, and being made of soft resilient rubber material. The nozzle 25 is secured to the base 19 of the flat brush 14 by means of flanges 26. The mouth 27 of the nozzle 25 is disposed at a relatively short distance from the unattached ends 28 of the bristles forming the flat brush 14. The lips of the nozzle 25, which form the mouth 27, normally bear resiliently against each other, so that they close the mouth 27. When the tinting medium passes through the lips, they open out to form a narrow slot through which the tinting medium is discharged into the flat brush 14. When the pressure in the container 10 is reduced, the lips of the nozzle brush 27 lie against each other, and thus close the mouth, so that no air can be drawn in from the exterior by way of the nozzle mouth.

The internal duct in the hair spreader 13 is designated by the numeral 29. The duct 29 extends from the discharge opening 15 of the hair spreader 13 to a valve compartment near the screw cap 16. The valve compartment is provided with a manually-operable rotatable change-over member 30. The member 30 is provided with a passage for tinting medium flow therethrough. The member 30 can be rotated so that its passage can be aligned with the duct 24 or the duct 29. FIG. 2 shows the rotatable, change-over member 30 in a first operating position, in which the duct 24 communicates with the interior of the container 10, and the duct 29 is isolated from the container interior. In a second operating position of the change-over member 30, the duct 29 communicates with the interior of the container 10, and the duct 24 is isolated from the container interior. In a third operating position of the rotatable change-over member 30, both the ducts 24 are isolated from the interior of the container 10. Thus, the tinting medium can be applied to the hair via the duct 29 and the hair spreader 13, or via the duct 24 and the flat brush 14. When using the flat brush 14, hair can be tinted at a distance from the tinting attachment. The implement can also be used without the application of tinting medium.

The hair-tinting implement is provided with an air-intake valve which is arranged on the screw cap 17. Such an air-intake valve is important, as air is drawn from the exterior into the container 10, when the container resiliently regains its initial shape because of the reduced pressure which is established in the container 10. The air-intake valve presents the tinting medium, contained in the ducts 24 and 29, from being sucked back into the container 10, and inhibits the intake of air from the exterior by way of these ducts. Such an intake of air is undesirable, being associated with unpleasant noises, and also rendering it difficult to apply precise amounts of the tinting medium to the hair.

Figure 4:
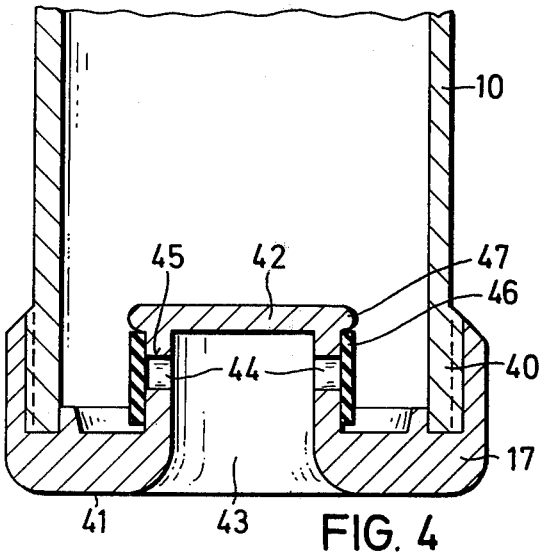
FIG. 4 is a cross-sectional view showing a first form of air-intake valve for the container of the implement.

As shown in FIG. 4, the screw cap 17 is secured on to an external thread 40 at the lower end of the container 10. The screw cap 17 is an injection-moulded plastics member, at the centre of the base 41 of which it has a cylindrical socket projection 42, which extends upwardly into the container 10, and which defines a recess 43 in the base 41 of the screw cap 17. A plurality of valve openings 44 are formed in the periphery of the socket projection 42, the valve openings extending through the cylindrical peripheral portion of the socket projection. This cylindrical peripheral portion forms a valve seat 45 for a resilient, ring-shaped valve closure member 46. The valve closure member 46 surrounds the socket projection 42, and overlies the valve openings 44. The valve closure member 46 is held on the socket projection 42 by means of a rim 47. When the container 10 resiliently recovers its shape, and when reduced pressure is thus set up in the container, the valve closure member 46 lifts slightly from the valve seat 45, so that air from the exterior can flow through the valve openings 44 into the interior of the container.

Figure 6:
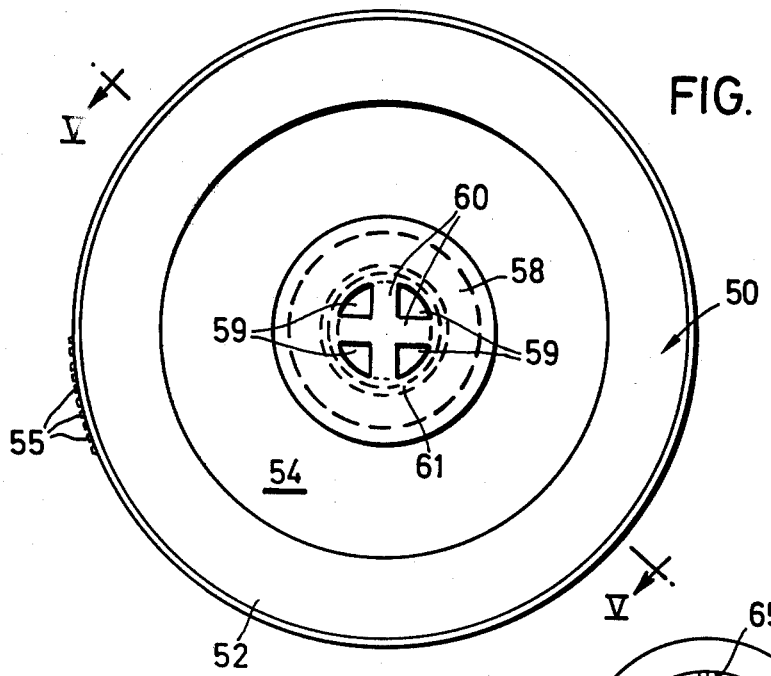
FIG. 6 is a view of the direction of the arrow VI of FIG. 5.
Figure 7:
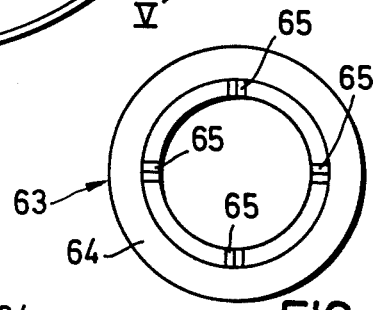
FIG. 7 illustrates, on a larger scale, a clamping member used with the air-intake valve of FIGS. 5 and 6.
Figure 5:
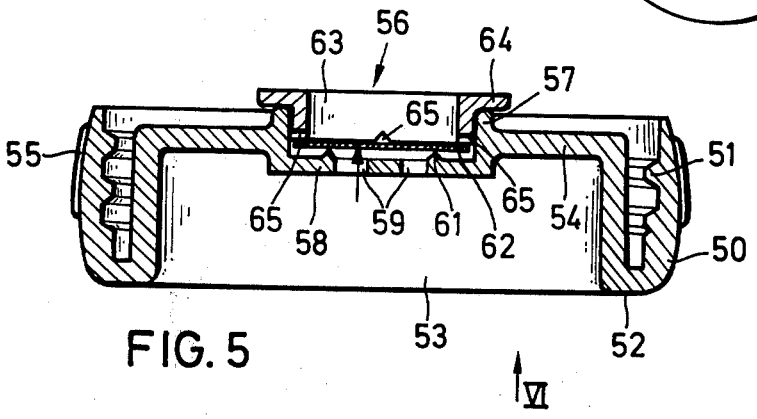
FIG. 5 is a cross-sectional view showing a second form of air-intake valve.

FIGS. 5 to 7 shows a second form of air-intake valve for use with the implement of FIGS. 1 to 3. The plastics sealing member 50, which closes off the base of the container 10, is here likewise formed as a screw cap. The screw-cap 50 has an internal screw thread 51 which can be screwed on to the external screw thread formed on the lower end of the container 10. The screw cap 50 has an annular base surface 52, which forms a surface on which the implement can be stood up, and which surrounds a dished recess 53. The dished recess 53 is defined by an integral internal socket 54. The outer periphery of the screw cap 50 is formed with ribs 55 which improve the grippability of the screw cap.

An air-intake valve 56 is arranged on the internal socket 54. The valve 56 is located in a central, integrally-formed cup-shaped member 57 of the internal socket 54. Four closely-spaced valve openings 59 are formed in the base surface 58 of the cup-shaped member 57, the valve openings each being constituted by a round hole or a segment of a circle. The valve openings 59 are separated from each other by webs 60, which form part of the base surface 58. A knife-edge, annular valve seat 61 is formed on the inner face of the base surface 58 that is presented to the container 10, the valve seat 61 surrounding the four valve openings 59. A valve closure member, which is constituted by a flat disc 62 and is made of a resilient material, overlies the valve openings 59. The diameter of the valve disc 62 is slightly less than the inside diameter of the cup-shaped member 57.

In order to urge the valve disc 62 against the valve seat 61, and to secure the valve disc within the cup-shaped member 57, use is made of a pressure member which consists of a plastics clamping ring 63. The clamping ring 63 has a flange 64 which overlies the cup-shaped member 57. On its annular face which is presented to the valve disc 62, the clamping ring 63 is provided with four groove-like recesses 65, which are arranged at intervals of 90° along its periphery. The clamping ring 63 is so formed that it is gripped by, and within, the cup-shaped member 57, and thus urges the resilient valve disc 62 against the valve seat 61 with the necessary pressure.

When the pressure in the container 10 is reduced, the resilient valve disc 62 lifts from the knife-edged valve seat 61, particularly at those places where the groove-like recesses 65 in the clamping ring 63 are located, so that air can flow through the valve openings 59, through the gaps opening between the valve disc 62 and the valve seat 61, and through the gap between the valve disc 62 and the cup-shaped member 57, so that the air reaches the container 10.

The valve of FIGS. 5 to 7 is of simple and economical design. Moreover, it has small dimensions, and its valve disc 62 is easy to fit and exchange without the use of special tools. The valve undergoes extremely slight contamination. It operates in a very precise manner and is not affected by vigorous shaking movements.

I claim:

1. A hair-tinting implement comprising a tinting-medium container, and a workhead provided with a tinting medium outlet, the container being generally cylindrical and being made of resiliently-deformable material, the workhead being attached to one end of the container and being provided with an internal duct which connects the interior of the container to the outlet, the other end of the container being closed off by a sealing member, an air-intake valve being provided in the sealing member, the air-intake valve being such as to open when the pressure in the container is less than that outside the container, wherein the air-intake valve comprises at least one valve opening passing through the sealing member, a valve seat formed on the interior surface of the sealing member, and a resiliently-deformable valve closure member which overlies the valve seat and said at least one valve opening, wherein the sealing member is provided with an integral socket projection which extends into the container and defines a recess in the sealing member, said at least one valve opening being provided in the socket projection.

2. An implement according to claim 1, wherein the workhead is provided with a comb, a spike-like hair spreader, and a flat brush.

3. An implement according to claim 2, wherein respective tinting-medium outlets are provided both on the hair spreader and the flat brush, and the workhead is provided with a pair of internal ducts which connect the interior of the container to the two tinting-medium outlets.

4. An implement according to claim 3, wherein the tinting-medium outlets can be closed selectively or simultaneously.

5. An implement according to claim 4, wherein the workhead is provided with a valve member which is effective to close either or both of the tinting-medium ducts.

6. An implement according to claim 3, wherein a flat, resilient nozzle is arranged within the flat brush, the lips of the nozzle, which bear resiliently against each other to close the nozzle mouth, being separable from each other by the pressure of the tinting-medium.

7. An implement according to claim 1, wherein the container is made of resiliently-deformable plastics material.

8. An implement according to claim 1, wherein the sealing member is made of plastics material.

9. An implement according to claim 1, wherein a screw cap comprises the sealing member, the screw cap having a screw-threaded edge portion which surrounds the air-intake valve and engages a complementary screw-threaded portion at said other end of the container.

10. An implement according to claim 1, wherein the socket projection is provided with a plurality of valve openings, all of which are overlaid by the valve closure member.

11. An implement according to claim 1, wherein the container tapers from said other end towards said one end.

12. A hair-tinting implement comprising a tinting-medium container, and a workhead provided with a tinting medium outlet, the container being generally cylindrical and being made of resiliently-deformable material, the workhead being attached to one end of the container and being provided with an internal duct which connects the interior of the container to the outlet, the other end of the container being closed off by a sealing member, an air-intake valve being provided in the sealing member, the air-intake valve being such as to open when the pressure in the container is less than that outside the container, wherein the air-intake valve comprises at least one valve/opening passing through the sealing member, a valve seat formed on the interior surface of the sealing member, and a resiliently-deformable valve closure member which overlies the valve seat and said at least one valve opening, wherein a flat disc comprises the resilient valve closure member, and wherein a cup-shaped member is formed integrally with the sealing member, the cup-shaped member accommodating the flat disc.

13. An implement according to claim 12, wherein the valve seat is a knife-edged annular rib formed integrally with the base of the cup-shaped member, the valve seat surrounding said at least one valve opening.

14. An implement according to claim 12, wherein the flat disc is held by a releasable plastics clamping member inserted into the cup-shaped member.

15. An implement according to claim 14, wherein the clamping member is a clamping ring.

16. An implement according to claim 14, wherein the clamping member is provided with groove-like recesses on that surface bearing against the flat disc.

17. An implement according to claim 12, wherein the sealing member is made of plastics material.

18. An implement according to claim 12, wherein a screw cap comprises the sealing member, the screw cap having a screw-threaded edge portion which surrounds the air-intake valve and engages a complementary screw-threaded portion at said other end of the container.

19. An implement according to claim 12, wherein the container tapers from said other end towards said one end.

* * * * *